United States Patent [19]

Andrews

[11] 4,117,376

[45] Sep. 26, 1978

[54] ELECTRIC ENERGY SAVING INCANDESCENT LAMP SOCKET COMBINATION SWITCHING DEVICE

[76] Inventor: Peter Andrews, 190 Gebhardt Rd., Penfield, N.Y. 14526

[21] Appl. No.: 761,665

[22] Filed: Jan. 24, 1977

Related U.S. Application Data

[63] Continuation-in-part of Ser. No. 442,082, Feb. 12, 1974, Pat. No. 4,005,334, which is a continuation-in-part of Ser. No. 240,605, Apr. 3, 1972, abandoned, which is a continuation-in-part of Ser. No. 25,994, Apr. 6, 1970, abandoned.

[51] Int. Cl.[2] ..... H05B 39/04

[52] U.S. Cl. ..... 315/200 R; 307/146; 315/64; 315/362; 315/DIG. 4

[58] Field of Search ..... 307/146; 315/64, 71, 315/200 R, 362, DIG. 4; 200/51.03, 51.04, 51.05

[56] References Cited

U.S. PATENT DOCUMENTS

| | | | |
|---|---|---|---|
| 3,028,523 | 4/1962 | Seid | 315/64 X |
| 3,062,986 | 11/1962 | Fritz et al. | 315/DIG. 4 |
| 3,256,466 | 6/1966 | Trolio et al. | 315/200 R X |
| 3,496,451 | 2/1970 | Duncan | 315/DIG. 4 |

*Primary Examiner*—Eugene R. LaRoche

[57] ABSTRACT

An improved electric energy saving incandescent lamp socket combination having in one embodiment a two-position electric "off-on" switching means, and in another embodiment having a four-position electric "off", low, medium and high switching means for a 1-way and a 3-way incandescent lamp respectively. The lamp socket houses therein a subcombination means that comprises a conventional two-position switching means having at least one single throw "off-on" electrical switching position and a half-wave, electric rectifying, diode which is electrically short-circuitingly connected to any two of generally three electrical terminals which project from at least one surface portion of the conventional two-position switching means. Thereby a person can actuate the lamp socket's two-position and/or four-position switching means and at substantially the same time, as desired, actuate the subcombination two-position half-wave rectified "dim" and full-wave "on" subcombination means for providing a one-way incandescent lamp with an electrical switched positions of "off-dim", "off-bright", "off-dim-bright", "off-bright-dim" and the like combinations. The four-position 3-way lamp socket switching means and two-position subcombination will provide eight separate combination of three illuminations, as desired, accordingly.

21 Claims, 5 Drawing Figures

ELECTRIC ENERGY SAVING INCANDESCENT LAMP SOCKET COMBINATION SWITCHING DEVICE

This application is a continuation-in-part of my copending application Ser. No. 442,082 filed Feb. 12, 1974, now U.S. Pat. No. 4,005,334, which was a continuation-in-part of my copending application Ser. No. 240,605 filed Apr. 3, 1972, now abandoned, which was a continuation-in-part of my copending application Ser. No. 25,994 filed Apr. 6, 1970, now abandoned.

BACKGROUND OF THE INVENTION

This invention relates to incandescent lamp socket half-wave diode dimming and electric switching means thereof for an electric non-dimming incandescent lamp which is inserted therein. Incandescent lamp dimming devices of various types having various electrical circuits and constructions are well known in the art. Six, state of the art, of many known prior art references, for example, are being cited herebelow accordingly, for providing a full or better understanding of the prior art and this invention at the time that this improved incandescent lamp socket invention, as a whole, was made.

J. B. Rickey — U.S. Pat. No. 3,518,602 — Issued June 30, 1970.

S. C. Peek, Jr. — U.S. Pat. No. 3,379,861 — Issued Apr. 23, 1968.

E. Seid — U.S. Pat. No. 3,028,523 — Issued Apr. 3, 1962.

W. H. Fritz et al — U.S. Pat. No. 3,062,986 — Issued Nov. 6, 1962.

R. C. Morton — U.S. Pat. No. 2,896,125 — Issued July 21, 1959.

C. E. Felch — U.S. Pat. No. 596,582 — Issued Jan. 4, 1898.

The 1970 Rickey device being the most common type of incandescent lamp dimmer in use today, is a variable incandescent lamp dimmer unit which is generally mounted into a wall electrical outlet box, and further which unit is mounted in the removable lamp plug adapter, and being inserted into a lamp socket receptacle, and thereby being located after, in that it is located between a single pole single throw or a single position electrical "on" switch and the filament of an incandescent lamp. Rickey's dimmer device is thereby generally uneconomical or impractical for use with a multiple, for example, four position electrical 3-way lamp socket switching means because at least one electrical switching position being thereby always wasted. In essence, it is like putting "the cart before the horse" drawback or disadvantage.

The 1968 Peek device being a commutator type of electrical resistor which is inserted into a removable lamp plug adapter, and regarding the conventional four position disclosed lamp socket switching means, it is only useful generally as is Rickey's device, but in Peek at least two electrical switching positions are always wasted.

The 1962 Seid 3-way lamp socket, silicon diode rectifying adapter is generally the same invention as that of the following Fritz device and is owned or assigned to the same company as is the Morton diode dimming device, hereafter also disclosed.

The 1962 Fritz, being a silicon rectifier or rectifying lamp dimming device or unit which is freely dropped into a lamp socket receptacle portion having two electrical contacts of a conventional four position 3-way incandescent lamp switching means therein. Then the base of a conventional single element lamp 10 is inserted into the receptacle portion of the socket for electrical contact with the dimmer device's center electrical contacting portion, to thereby provide an off, bright, dim and the same first position bright illuminating position, in one revolution of the conventional ratchet type of four position lamp socket's switching means, and thereby repeating one electrical illuminating position with use of the conventional four position switch. Thereby, electricity is always wasted, as well as one switching position, and being the only use and combination of illuminations possible, thus providing the utility, as stated, for a single element lamp only and thereby also at least wasting money because of the second bright illuminating switching position for each single revolution of the switch, and when only one filament is desired to be illuminated and then switching the switch of the 3-way lamp socket switching means to its "off" position.

1959 Morton device also shows a half-wave diode rectifying means for a single element lamp and having the rectifying means in combination with a wall mounted switch, making it impossible to dim one lamp of a two, three or four lamp fixture means, or a chandelier, or even any lamp in a fixture which is electrically connected directly to a conventional 24 volt relay means from the wall position. Morton also having a rectifying means electrically connected between a selectively switching means and a lamp inserted in a lamp socket as shown in FIG. 3 of Morton's drawing. Here again is the disadvantage, as is generally in all the prior art, whereby here again "the cart is put before the horse" and especially, for example, when a conventional 3-way switching means is present in the fixture or lamp socket means whereby the lamps full 3-way illuminating utility is not recognized or suggested, as in the objects disclosed hereafter.

The, generally 76 years old, 1898 Felch lamp dimming combination device being in the form of a lamp socket having an electrical heat producing and an electrical energy wasting resistance medium therein. The medium is manually rotated and elevated by a knob member located on the outside of the lamp socket housing, when a lamp is thereby desired to be dimmed.

OBJECTS OF THE INVENTION

A very important object of one of the embodiments of my improved lamp socket invention is having a multiple electrical selectively switching means in electrical connected combination with at least one subcombination of at least one electrical selectively switching means and at least one half-wave diode rectifying means, whereby a 3-way lamp, for example, of the 30, 70 and 100 watt type, can be electrically illuminated into 8 different, groups of 3, combinations of light intensities or lamp illuminations of, for example, (1) low, medium and high; (2) rectified half-low, half-medium and half-high; (3) rectified half-low, rectified half-medium and high; (4) rectified half-low, medium and high (5) low, medium and half-high; (6) low rectified half medium and rectified half-high; (7) low, rectified half-medium, and high; (8) rectified half-low, medium and rectified half-high; accordingly, as desired, with each group of the eight combinations additionally having the conventional "off" electrical switching position by using the "off" electrical switching means, of the four-position 3-way lamp socket switching means.

Another object of my invention, having the immediately above mentioned subcombination electrically connected ahead of a conventional multiple switching 3-way lamp socket means, is to provide a new and improved multiple selectively switching means which is substantially housed in the improved lamp socket invention whereby the actuation of only one switch knob is required for an "off"; rectified "half-on"; and a non-rectified full-wave "on" electrical switching position, for example, for at least one single filament incandescent lamp or so that eight "off" and eight separate levels of illumination for at least one 3-way lamp, anf further at least one or all of the previously disclosed eight separate levels of illumination or even at least one or all of the previously disclosed eight different groups of three combinations of illumination are thereby obtainable, as desired, in a facile, economical and very efficient way, while at the same time saving electric energy, electricity, money and provide longer lamp life accordingly.

Another object of my improved lamp socket invention is to discourage burglars from entering an electric lamp illuminated house, for example, by having one of the two filaments of a 3-way electric incandescent lamp in its half-wave rectified "dim" illuminated state when an electrically plugged in automatic electric clock timer is used for illuminating a house at night, when the house is unattended or a person is on vacation. When a standard full-wave illumination of the one filament, as is conventionally done, is being timed it has a burn out factor of 1–30 against the half-wave "dimmed" filament and electric energy is not saved and money is also wasted thereby. Now if the two filaments in a 3-way lamp are half-wave dimmed, then there is still a 30–1 factor that both filaments will not burn out, leaving the house in a timed but darkened house state that encourages burglars to enter it, and yet at least 40 percent of electric energy and money will still be saved over two full-wave illuminated filaments of the 3-way lamp.

A yet another object of my invention is to provide a new and improved combination of a multiple position electric selectively switching means for at least one portion of an incandescent lamp fixture so that, as a whole, less electrical generated power is required by a generator means, and especially when at least one incandescent lamp is at least half-wave dimmed by the use of a very cheap and simple half-wave diode rectifying semi-conductor means, whereby, for example, almost 50 percent of electricity is saved. And further at least saving of, for example, the 50 percent of electricity is obtained in one direct, positive and simple manual switching operation over that of a variable "SCR" incandescent lamp dimming means which at times does not save the 50 percent of electrical energy.

And still another object is to save electrical energy, money and incandescent lamp life of a 3-way incandescent lamp by merely first half-wave "dimming" the second full-wave "medium" and the third full-wave "high" illuminations before a person decides to switch from the first full-wave conventional "low" position directly to the electrical "off" position of the lamp. The wasted electric energy, at least, is caused by the conventional switching of from "low" to "medium" and then to "high" before the electrical "off" position is reached. The half-wave dimming saves electrical energy, at least, over the full-wave "medium" and "high" illuminations. The improved lamp socket switching invention can be switched into either its half-wave or full-wave positions before any electrical current is passed to any filament member in any type of incandescent lamp.

DETAILED DESCRIPTION OF THE INVENTION

Figure 1:
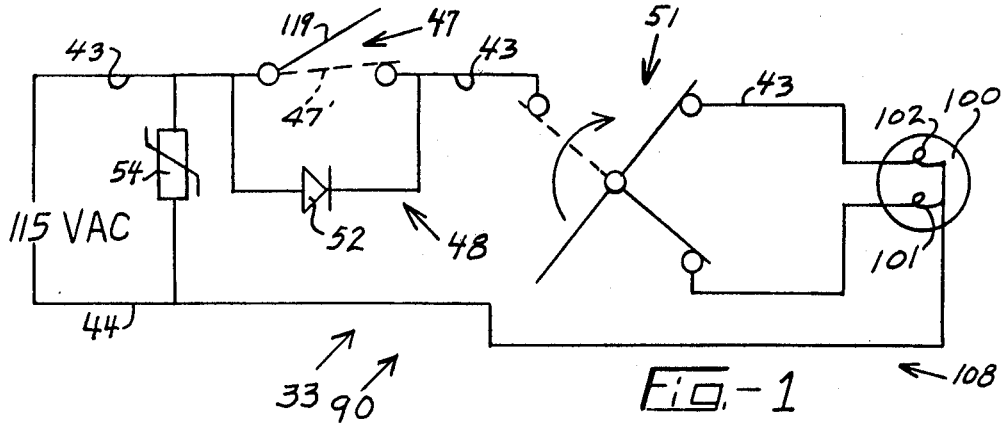
FIG. 1 is an electric-schematic circuit diagram usable in at least one embodiment of the present improved lamp socket switching invention.

FIG. 1 shows the 115 VAC supply of electric current source having a "G.E.MOV" varistor 54 electrically connected across the electric conducting wires 43 and 44, for at least protecting the diode 52 from being creamed by high electrical current surges, voltage transients, and the like. The electric energy saving incandescent lamp socket combination switching device 90 is shown by arrow means, as to the improved invention portion thereof taken with FIG. 2.

FIG. 1 shows electrical conductor wire 43 electrically connected to a subcombination means 48 which has a non-rotary 2-position "off-on" switch 47 means shown in its open, half-wave diode rectifying 52, lamp 100 dimming electrical current passing position. When the switch 47 is in its dashed-line closed position 47' then the electrically connected rectifying means 52 is shuntingly by-passed. The switch 47 is electrically connected to a conventional 3-way electric selectively, for example, lamp socket 108 switching means 51 which is shown in its open "off" electrical position. When a 3-way incandescent lamp means 100 is inserted into the 3-way lamp socket means 108 then the disclosed 8 combinations of 3 separate illuminations from the lamp 100 and/or filaments 101 or 102, or 101 and 102 is thereby made possible, as disclosed in the objects.

Starting, for example, from the 115 VAC source of electrical current supply one end of the electrical conducting wire 43 must, of course, be electrically connected, regardless of which switches, subcombinations and the like is electrically connected therebetween, substantially to one end of the filaments 101 and 102 for completing all of the electrical circuits and then generally back through the second electrical conducting wire 44 to the 115 VAC source of electric current supply, as shown for example, in FIG. 1. The rotation of the knob 4, shown in FIG. 2, will actuate the FIG. 1 switching means 51 into its four conventional positions of one "off" and three "on" and the axial movement, shown by arrow means 14, of the knob 4, will actuate the, for example, cherry or micro switching means 47 into their now half-wave rectified "dim" and full-wave "on" two positions as is structurally substantially shown in FIG. 2, for example. The diode 52 and the switching means 47 of the subcombination means 48 do not necessarily have to be electrically connected in close or closely adjacent relationship as is shown in FIG. 2, if so desired.

Figure 2:
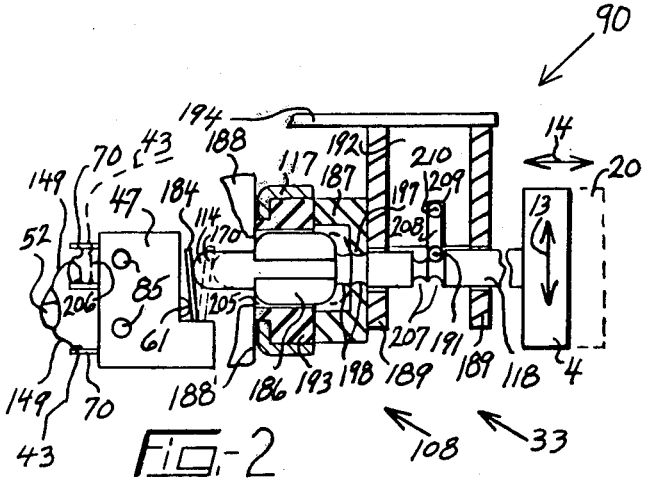
FIG. 2 is a cut away fragmentary side elevational plan view of a dual, rotary and axial, selectively switching and dimming means which is substantially housed substantially in the base portion of an incandescent lamp socket means of one embodiment of the improved lamp socket combination switching device.

FIG. 2 shows a cut away fragmentary base portion of an improved conventional lamp socket 108 and which also represents a lamp 9 socket 33 which is shown in FIG. 7 of my copending application Ser No. 442,082 and since a portion of both types of sockets 33 and 108 are used in the improved combination socket device 90 which is shown by arrow means. The improved portion of the combination may be enclosed in a standard lower shell base and an upper shell portion (not shown) of a lamp socket 33 and 108, for example, if so desired, especially if a small "MICRO SWITCH" 47 is used, for example.

When a person rotates the knob 4, the substantially conventional bridging contact carrier disc 193 is ratched along with the rotary conventional electrical bridging electrical ratcheting contact member 117 in a conventional way accordingly as desired. Thereby, for example, a 2-filament 3-way lamp 100 will be switched into an "off" and a half-wave "low-dim", "medium-dim" or "high-dim" positions as desired. The half-wave dimming of the 3-way lamp was accomplished because the end 114 of the rod-like member 118 had been operatively manually axially pushed 14 into its shown detented position and thereby the, for example, "CHERRY" or "MICRO SWITCH" 47 arm 184 depressed or forced the switch 47 actuating button 61 substantially into the switch 47. Thereby, the switch 47 contacts are separated (not shown) into an open position, as is generally shown in FIG. 1, by having switch arm 119 raised, and the diode 52 being electrically short-circuitingly connected directly into the electrical circuit to the 3-way switch 51 and lamp 100 filaments 102 or 101, or 102 and 101, respectively, as is shown in FIG. 1.

Now, when the knob 4 is operatively manually axially pulled back to its dashed line position 20, then the end 114 releases the arm 184 to its dashed line rest position 170 which is conventionally created by an internal spring action within switch 47 against a housed portion of the button 61 which in turn, forces the arm 184 to its rest 170 position. The switch 47 is now in its closed "on" position, when the diode 52 is short-circuitingly electrically connected to the electrical outside terminals 70, and thereby by-passes the diode 52, as is generally shown in FIG. 1 by the solid switch arm 119 and being in its moved dashed line 47' position. When, if so desired, an axial lead 149 of diode 52 and the electrical lead-in conducting wire 43 is electrically connected to the center terminal 70 of the switch 47, as is shown by the wire 43 dashed line 206, then the above previously disclosed "dimming", "on" and axial movement of the end 114 and knob 4 will bring opposite results, of a full-wave "on" when button 61 is depressed and a half-wave "dim" when button 61 is not depressed, accordingly. It should be noted that the knob 4 may be axially moved at any desired time regardless of the rotary position of the electrical contact member 117 by means of the slotted 205 portion in insulated rotating disc 193. Thereby, the 8 combinations of 3-illuminations from one 3-way lamp is made possible, as disclosed in the objects.

FIG. 2 further shows an improved disc 193 which is made of an electrical insulating material and having a slot 205 through the thickness portion of or two faces or sides of the disc so that the swedged out key-like integral portion 186 of rod-like member 118 may move axially 14 therein. The spacer 187 spaces the disc 193 to one side of the conventional opening and against an insulating inner wall 188' portion 188 of the lamp socket 108 and 33 so that axial end play of the disc 193 is at a desired controlled limiation or dimension. The spacer 187 has an integral thin generally resilient wall portion 197 member at an end portion thereof for generally resiliently detenting action into and out of the two circular grooves 198, if so desired. The disc 193 may also be used without the wall portion 197 of spacer 187 when the hair pin type of spring 209 is confined sideways in a slot 208 of substantially the spring 209 supporting housing member 192. A lower detenting portion 191 of the spring 209 is detented into the two circular grooves 207 when the rod-like member 118 alone or with the knob 4 thereon is axially moved to the dashed line position 20 and moved back to its initial shown position to thereby prevent accidental axial inward movement of knob 4 when it is manually rotated and to retain the end 114 of rod-like member 118 in its shown forward position against the conventional internal spring return action of the switch 47 arm 184, also when the knob 4 is generally forwardly rotated 13, if so desired. Only one circular groove 207 will be required when the substantially hair pin spring 209 type is used but the slot 208 would have to be of the outer shape of an upside down (not shown) capital vee. Both detenting means 197 and 191 may be used at the same time, if so desired. Two switch 47 mounting holes 85, two stem or rod-like member 118 support insulating material members 189 and a portion of a conventional insulating lamp center contact supporting disc member 194 for also substantially retaining the spring 209 supporting housing member 192 in place, is also shown. The rod-like member 118 grooves 207 may be detentingly located between the upper 210 and lower 191 members of the spring 209 which must thereby be downwardly moved to a different position from that which is shown. Thereby a hole or slot (not shown) would have to be inserted traversely substantially through the slot 208 in a longer extended length bottom portion of the housing member 192, if so desired, whereby the new hair spring detenting action is still preserved. The housing member 192 would have to extend below the bottom of rod-like member 118, generally to the bottom end portions of members 189.

Figure 3:
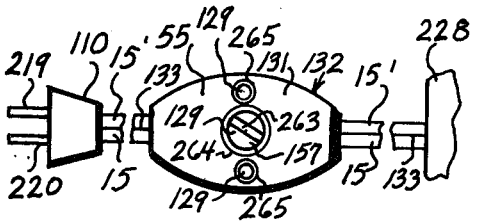
FIG. 3 is a side elevational horizontal view of a "MOV" "MOV" (metal oxide varistor) Electric Cord Device being attached to an electric cord means which has an electric cord plug-in means at one end thereof while the other end of the cord is electrically connected to an electrical device having semiconductor components therein, accordingly.

FIG. 3 shows an "Electric Cord Feed-Thru Varistor Device" 55 secured to an electric-twin cord 133. A conventional slotted 263 screw 157 is shown in a counterbored hole 264 and having a threaded nut, not shown, on its other end, as is conventionally done with electric feed-thru wheel cord switches. FIG. 3 further shows the cord 133 connected to an electric twin cord plug-in member 110 having two conventional electric plug-in prongs 219 and 220. The other end of the cord 133 is electrically connected, not shown, to an electrical device 228, for example, having at least one semiconductor device therein that will be protected by the device 55 against voltage transients. The cord 133 having two insulated twin members 15 and 15' having electric conducting wires 43 and 44 therein. The varistor 54 which is housed in two half casings 131 and 132 is automatically electrically connected to and across the wires 43 and 44 by two separated pointed members 134, not shown, but are the same as the pointed members which are used in the feed-thru wheel 35 type of cord switch means 56 which is shown and used in FIGS. 7 and 37. The varistor 54 is thereby automatically electrically connected to the wires 43 and 44, at the points 134 and 135 as is shown in FIG. 33, for example. Two small holes 265 having rivets 129 therein may also be used, if desired, as when the device 55 is riveted to the electrical devices or cord 133, when the equipment 238 is delivered.

Figure 4:
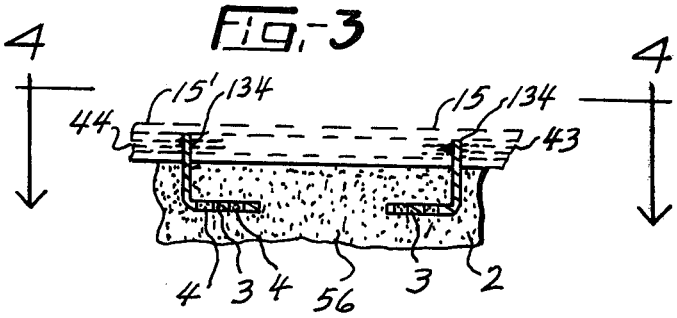
FIG. 4 is side view of another "MOV" device embodiment having a two wire piercing points 134 protruding out of substantially a "MOV" material.

The main purpose of the "Electric Cord Varistor Device" 55 shown in FIG. 3 is to save money by saving the electronic equipment from voltage transients, by providing a varistor 54 of, for example, the disclosed oxide diode type or the "G.E. MOV", TYPE VP, into substantially the disclosed casing means 131 and 132 so that the varistor device 55 may be automatically piercingly electrically connected bridgingly across the two electrical conductors or wires 43 and 44 as is generally shown in FIG. 4 and/or 5. Electrical connection of the Electric Cord 'MOV' Varistor Device 55 is desired so as to have voltage transient protection means substantially for protecting at least one semiconductor component in an electrical device 228. Some of these components, for example, are capicotors; half-wave diodes; thyristors; SCR's; Triacs; transistors and the like. Dimming and non-dimming incandescent lamps; or basically, television sets; radios; electronic equipment; electronic computors and the like will also be protected against transient voltage spikes or in line surges by the device 55. A high voltage pulse or spike may be generated from external sources and even lighting.

FIG. 4 shows a cross-sectional portion of another embodiment of the "MOV" device 56 showing the sideways staggered electric wire 15 and 15' electric wire piercing points 134 which are made of an electric conducting material. The "MOV" material 2 is the same material at that which is is described in Canadian Pat. No. 831,691 which has a nonlinear voltage versus current characteristics and also that "MOV" material 51 which is described in U.S. Pat. No. 3,821,686. Also the material 1 comprising zinc oxide, bismouth oxide, antimony oxided and nickel floride which is described in U.S. Pat. No. 3,811,103 may be used as desired as the material 2 shown in FIG. 5.

Figure 5:
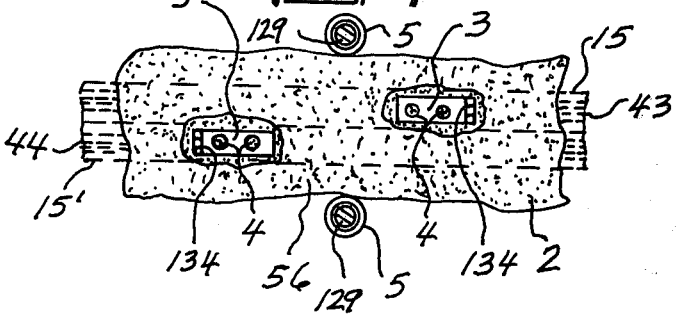
FIG. 5 is a top plan view of FIG. 4.

FIG. 5 shows the angular shaped bottom portion 3 of points 134 embedded in material 2. Openings 4 are used for additional embedding strength in material 2, if so desired. The integral material embedded portion 3 of points 134 may be twisted and the like as desired. The points 134 may be a single point 134 or double pointed 134 type as is desired.

While the description of my particular invention is in reference to the particular embodiments shown, it is obvious that various modifications can be resorted to without departing from the spirit of the invention or the scope of the subjoined claims.

I claim:

1. An electrical energy saving improved lamp socket switching means for providing a half-wave rectified and a full-wave of electric current to an incandescent lamp, comprising in combination:

a said lamp contact shell means positioned on a disc-like member of electrical insulating material having at least one electrical contact member means protruding through at least one surface portion thereof for electrical contact with at least one electrical contacting portion of said lamp when said lamp is removably inserted into said shell means;

said disc-like member being secured to an insulating housing member which substantially houses a first switching means in one portion thereof for switching electric current which is passed thereto by a second switching means, substantially to at least one filament member of said lamp;

said second switching means having a switch supporting portion substantially housed in at least one portion of said insulating housing member;

said first switching means having a rod-like member having a first end portion thereof rotatingly supported by at least one electrical insulating member means which is substantially housed in said insulating housing member;

said first end portion of said rod-like member extends out of and beyond an outer diameter portion of said insulating housing member for manual switching rotation and axial switching movement thereof;

said rod-like member also having a generally center portion and a generally end portion which has at least one diameter portion thereof coined outwardly to form at least one generally flat ear-like member which substantially slides substantially captively and also axially key-like within a correspondingly matching key-like opening in an insulating rotating member which has a one-piece rotatable electric current conducting contact member which rotatingly contacts at least two radially spaced electric contact members which are constructed from a resilient electrical conducting material;

said insulating rotating member with said conducting contact member are axially substantially captively retained in one portion of said insulating housing member;

said second switching means having at least one "off" and "on" electrical switching position and having at least two a first and a second electrical terminal;

said second electrical terminal is electrically connected ahead of and to one electrical passing member of said first switching means;

said first and said second said terminal having a half-wave diode electric rectifying means electrically connected thereto for alternatingly passing either a half-wave rectified "dim" or a full-wave "on" portion of said electric current to said first switching means when an outer end edge portion of said rod-like member is axially moved by exerting a manual axial force on said first end portion thereof so that said outer end edge portion will thereby depress and release a switch actuating member of said second switching means;

said first switching means having an electrical "off" switching position and at least one "on" electrical switching position when said first end portion of said rod-like member is manually switchingly rotated.

2. In the combination of claim 1 wherein said shell means is securedely positioned to said disc-like member.

3. In the combination of claim 1 wherein said disc-like member having one centrally located electrical contact member means for electrically contacting a centrally located contact member of a single filament said lamp and said first switching means having an electrically "off" and an "on" switching position;

said lamp socket switching means is so constructed and arranged that when said first end portion of said rod-like member is manually manipulated rotatingly and axially then said single filament said lamp will be in an electrical "off" and half-wave "dim"; "off" and full-wave "on"; "off" and "dim" and "on"; "off" and "on" and "dim" when only one revolution of said first end portion is manually made at each of the above 4 switching sequences.

4. In the combination of claim 1 wherein said disc-like member having one centrally and one off-center located electrical contact member means for electrically contacting a centrally located and on a circular generally off-center located contact member of a two filament 3-way said lamp and said first switching means having an electrical "off" and three electrical "on" switching positions;

said lamp socket switching means is so constructed and arranged that when said first end portion of said rod-like member is manually manipulated rotatingly and axially then said 3-way said lamp will be in eight different combinations of three illuminations and eight separate electrical "off" non-illuminated state.

5. In the combination of claim 1 wherein said second switching means having three said terminals a first second and third so that a person can electrically half-wave "dim" said lamp by either axially pulling or pushing on said first end portion of said rod-like member.

6. In the combination of claim 1 wherein said first switching means passes electric current substantially to two filament members of said lamp.

7. In the combination of claim 1 wherein said second switching means having said supporting portion thereof adhesively secured to at least one portion of said insulating housing member.

8. In the combination of claim 1 wherein said second switching means having said supporting portion thereof secured by riveting means to at least one surface portion of said insulating housing member.

9. In the combination of claim 1 wherein said second switching means having said supporting portion thereof removably secured by threaded screw means to at least one surface portion of said insulating housing member.

10. In the combination of claim 1 wherein said first end portion of said rod-like member having a knob means on an outer end projecting portion thereof for aiding in the rotation and axial movement thereof.

11. In the combination of claim 1 wherein said first end portion of said rod-like member having a knob means adhesively secured to an outer end projecting portion thereof.

12. In the combination of claim 1 wherein said first end portion of said rod-like member having a knob-like member removably secured to an outer end projecting portion thereof.

13. In the combination of claim 1 wherein said first first end portion is rotatingly supported by two electrical insulating member means which are substantially housed in said insulating housing member.

14. In the combination of claim 1 wherein a spacer means having a longitudinal diameter portion of said rod-like member axially retained in an opening through said spacer means which is inserted between one face edge portion of said insulating rotating member and one side portion of said electrical insulating member means for restricting axial movement of said insulating rotating member and said conducting contact member which is in substantially rotating contact with an inside wall portion of said insulating housing member.

15. In the combination of claim 14 wherein said diameter portion of said rod-like member is snugly slidably fitted in said opening through said spacer means in substantially an axial detenting way.

16. In the combination of claim 15 wherein said diameter portion of said rod-like member having two circular grooves formed therein so that at least one inside diameter portion of said opening in said spacer means will be axially detented in said two said grooves when said rod-like member is axially moved for substantially actuating said second switching means.

17. In the combination of claim 1 wherein said generally center portion having two spring detenting first and second circular groove in a longitudinal portion of said rod-like member; a spring detenting means is held laterally captive and having at least one longitudinal portion thereof detentably retained in said first and then in said second circular groove when said rod-like member is axially moved for substantially passing a half-wave and a full-wave of electric current substantially to said first switching means and to said lamp; said spring detenting means being substantially housed in a slotted portion of a spring supporting housing member which is substantially housed in one portion of said insulating housing member.

18. In the conbination of claim 1 wherein said generally flat ear-like member snugly slides through at least one portion of said matching key-like opening for retaining an axial moving portion of said outer end edge portion of said rod-like member in a desired substantially detented position depressingly against and releasably from said actuating member of said second switching means.

19. In the combination of claim 1 wherein said conducting contact member rotatingly contacts three said spaced electric contact members and said disc-like member having two a first and a second electrical contact member for electrical contact to two insulated apart contact members of a 3-way said lamp.

20. In the combination of claim 1 wherein said second switching means is a "MICRO SWITCH" type of switching means.

21. In the combination of claim 1 wherein said second switching means is a "CHERRY" type of switching means.

* * * * *